US010287776B2

(12) United States Patent
Dilio

(10) Patent No.: US 10,287,776 B2
(45) Date of Patent: May 14, 2019

(54) DECORATIVE RAILING WITH ADJUSTABLE ATTACHING BLOCK

(71) Applicant: Joseph Dilio, Mullica Hill, NJ (US)

(72) Inventor: Joseph Dilio, Mullica Hill, NJ (US)

( * ) Notice: Subject to any disclaimer, the term of this patent is extended or adjusted under 35 U.S.C. 154(b) by 148 days.

(21) Appl. No.: 15/196,339

(22) Filed: Jun. 29, 2016

(65) Prior Publication Data

US 2018/0002948 A1 Jan. 4, 2018

(51) Int. Cl.
*E04F 11/18* (2006.01)

(52) U.S. Cl.
CPC ..... *E04F 11/1808* (2013.01); *E04F 11/1804* (2013.01); *E04F 11/1836* (2013.01); *E04F 2011/1821* (2013.01); *E04F 2011/1897* (2013.01); *Y10T 403/125* (2015.01)

(58) Field of Classification Search
CPC ..... E04F 11/1804; E04F 11/1808; E04F 11/1836; E04F 2011/1819; E04F 2011/1821; E04F 2011/1868; E04F 2011/1897; E04H 17/1421; E04H 2017/1452; F16B 9/026; Y10T 403/12; Y10T 403/125
USPC ..... 256/65.01, 65.02, 65.03, 65.08, 65.16; 403/3, 4
See application file for complete search history.

(56) References Cited

U.S. PATENT DOCUMENTS 4,586,697 A * 5/1986 Tornya ..... E04F 11/181 256/22
5,964,452 A 10/1999 Summers
6,874,766 B2 * 4/2005 Curatolo ..... E04F 11/1817 256/65.02
7,543,802 B2 * 6/2009 Petta ..... E04F 11/1812 256/65.03
8,167,275 B1 5/2012 Bizzarri et al.
9,637,932 B2 * 5/2017 Schneider ..... E04H 17/1421
9,790,689 B2 * 10/2017 Milanowski ..... E04F 11/1842
2015/0211235 A1 * 7/2015 Sneith ..... E04F 11/1834 248/219.1

FOREIGN PATENT DOCUMENTS

EP 2113618 A1 * 11/2009 ..... E04F 11/18
FR 3005079 A1 * 10/2014 ..... E04H 17/168
FR 3016650 A1 * 7/2015 ..... E04F 11/1817
GB 121783 A * 12/1918 ..... E04F 11/1804

* cited by examiner

*Primary Examiner* — Josh Skroupa
(74) *Attorney, Agent, or Firm* — Norman E. Lehrer

(57) ABSTRACT

The railing extends between and is secured to posts or other substantially vertical surfaces so as to function as a hand rail. It includes an elongated extruded structural core member which has a left vertical wall and a right vertical wall spaced therefrom. A horizontal wall extends between the vertical walls forming a substantially H-shaped cross-section with an open top and an open bottom. A block is secured to an end of the structural member and is adapted to attach the member to a vertical surface. The block has the ability to be secured to the structural member in a plurality of different orientations to thereby allow the structural member to be attached to the vertical surface in a plurality of different angles relative thereto. Top and bottom finishing caps close the top and bottom of the structural member. Each of the right and left walls includes opposing slots for holding elongated decorative sheet material so that the appearance of the railing can be changed.

14 Claims, 11 Drawing Sheets

DECORATIVE RAILING WITH ADJUSTABLE ATTACHING BLOCK

BACKGROUND OF THE INVENTION

The present invention relates to a decorative hand railing and, more particularly, to a hand railing that can easily be connected to a post or column or wall at various angles and be securely attached thereto.

Hand railings have been around forever. Over the years, they have been made of various materials and have taken various shapes. More recently, with the advent of strong durable vinyl, they have found many uses out doors on porches, walkways, stairs and the like.

As is well known in the art, vinyl is not used alone to form vinyl railings since it is not structurally strong enough. Rather, the core of vinyl railings is normally formed of extruded aluminum which can have various different cross-sectional shapes. The aluminum forms the structure of the railing while the vinyl is the finish or decorative portion thereof.

In practice, a vinyl sleeve fits over the extruded core or lengths of vinyl caps snap over portions of the core to form the railing. The vinyl may come in different colors or finishes. But once attached to the core, they normally cannot be changed. The home owner or property owner must live with whatever color or design he or she has chosen unless they remove the railing and start again. To Applicant's knowledge, no railing system presently exists that allows the owner to change the appearance thereof once it is installed.

Other problems exist with known railing systems that sometimes make them difficult to install. The ends of the hand rails must be secured to posts or columns or other vertical surfaces such as a building wall or the like. This is not normally a difficult problem when the railing and the vertical surface meet at a substantially 90° angle. In such a case, a rectangular block or an L-bracket is secured to the core of the railing and then to the vertical surface.

The problem arises when attempting to secure the railing to a vertical surface that is at an angle to the railing either vertically or horizontally. This occurs, for example, with respect to a hand rail used on a staircase. The railing may be at an angle of 30° or 45° or substantially any angle from the horizontal relative to the top and bottom post or wall or the like to which it must be attached. A similar problem exists when a horizontal railing is to be attached to a vertical surface and must extend away from the surface to the left or right at an angle that is more or less than 90°.

With current railing systems available today, there is no easy way to securely attach the rail a vertical surface at an angle (other than 90°). There is no connector that universally adjusts to or accepts any angle. To Applicant's knowledge, this is currently done using the same L-bracket or block with a longer screw extending through the same to be attached to the vertical surface. This results in a relatively weak attachment. In the prior art known to Applicant, when the railing is attached to a vertical surface at an angle, there is only a single point of contact between the core and the surface.

There have been attempts in the past to address the problem of securing a railing to a vertical surface at an angle but to Applicant's knowledge, none has been successful.

U.S. Pat. No. 5,964,452, for example, shows a block inserted into the end of a railing and is pivotally mounted thereto. While this may allow the railing to be secured to a vertical surface at different horizontal angles, it does not allow for different vertical angles. Furthermore, it is attached to the rail at only one pivot point, thereby making it less secure. It could possibly pivot and move after installation.

U.S. Pat. No. 8,167,275 to Bizzarri also shows a block that can be pivotally attached to a rail and adjusted to different angles. But again, it does not allow for different vertical angles.

There is, therefore, a need for a railing system that can be easily and securely connected to a post or other vertical surface at different vertical or horizontal angles and which allows for the appearance of the same to be changed whenever desired.

SUMMARY OF THE INVENTION

The present invention is designed to overcome the deficiencies of the prior art discussed above. It is an object of the present invention to provide a railing that can be easily and securely attached to a post or other vertical surface.

It is another object of the present invention to provide a railing that can be easily and securely attached to a post or other vertical surface at different vertical angles.

It is a further object of the present invention to provide a railing that can be easily and securely attached to a post or other vertical surface at different horizontal angles.

It is a still further object of the present invention to provide a railing that can be easily and securely attached to a post or other vertical surface at different angles and which can have its appearance changed when desired.

In accordance with the illustrative embodiments demonstrating features and advantages of the present invention, there is provided a railing that extends between and is secured to posts or other substantially vertical surfaces so as to function as a hand rail. It includes an elongated extruded structural core member which has a left vertical wall and a right vertical wall spaced therefrom. A horizontal wall extends between the vertical walls forming a substantially H-shaped cross-section with an open top and an open bottom. A block is secured to an end of the structural member and is adapted to attach the member to a vertical surface. The block has the ability to be secured to the structural member in a plurality of different orientations to thereby allow the structural member to be attached to the vertical surface in a plurality of different angles relative thereto. Top and bottom finishing caps close the top and bottom of the structural member. Each of the right and left walls includes opposing slots for holding elongated decorative sheet material so that the appearance of the railing can be changed.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there are shown in the accompanying drawings forms that are presently preferred; it being understood that the invention is not intended to be limited to the precise arrangements and instrumentalities shown.

DETAILED DESCRIPTION OF THE PREFERRED EMBODIMENTS

Figures 1, 2:
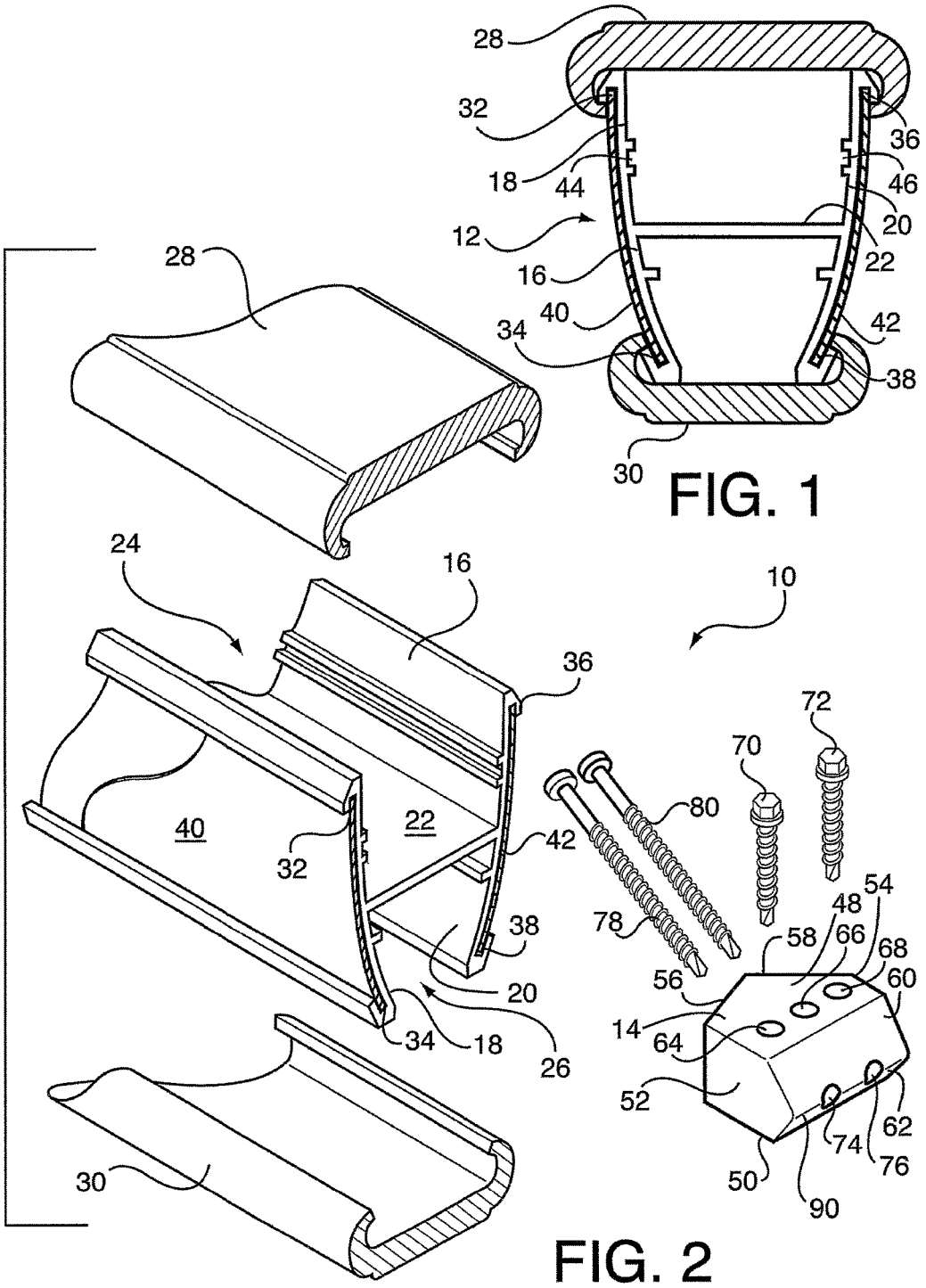
FIG. 1 is a cross-sectional view of a decorative railing showing one aspect of the present invention.
FIG. 2 is an exploded perspective view showing the component parts of the railing of the invention and a first embodiment of a connecting block.
Figure 3:
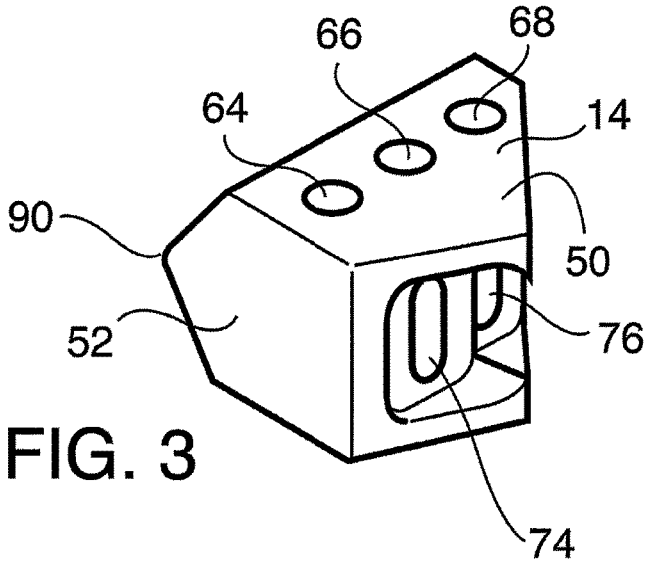
FIG. 3 is a rear perspective view of the connecting block of FIG. 2.

Referring now to the drawings in detail wherein like reference numerals have been used throughout the various figures to designate like elements, there is shown in FIGS. 1-9 a first embodiment of a decorative hand railing constructed in accordance with the principles of the present invention and designated generally at 10. The hand railing 10 is comprised of two main components, the railing 12 and the connector block 14 (FIG. 2) that connects the railing 12 to a post or column or wall or other vertical surface.

The railing 12 is comprised of an elongated extruded core member 14 which is preferably made of aluminum or other lightweight but strong metal. It is, however, not beyond the scope of the present invention to extrude the member 14 from a strong, rigid plastic material. In any event, the elongated member 14 functions as the core and structural support member for the railing 12.

The core or structural member 16 includes left and right spaced apart substantially vertically extending side walls 18 and 20. These walls 18 and 20, of course, extend the length of the structural member 16. A substantially horizontal wall 22 extends between the vertical walls 18 and 20 to form a substantially H-shaped cross-section throughout the length of the structural member 16. This leaves an open top 24 and an open bottom 26 throughout the length of the member 16.

Top and bottom caps 28 and 30 snap over the top 24 and bottom 26 of the structural member 16 after it is installed in a manner otherwise well known in the art. As shown in FIG. 1, however, it is preferable that the caps leave the side walls 18 and 20 exposed. The caps 28 and 30 extend the full length of the railing and are preferably made of vinyl or other similar material and can be made in various colors and textures or patterns, if desired.

The outer surface of each of the side walls 18 and 20 at the top and bottom thereof includes pairs of elongated slots such as shown at 32, 34, 36 and 38. Decorative sheet material such as shown at 40 and 42 is shaped so as to fit within the slots. The sheet material 40 or 42 can be made of plastic or other material and can be made of various colors or textures or patterns or the like so as to decorate the railing. The sheet material 40 and 42 is held within the slots but can be removed therefrom so that it can be changed if desired. Preferably, the sheet material 40 and 42 extends the full length of the railing although it is not beyond the scope of the present invention to have the sheet material extend only a part of the way or to have different sheet materials or other matter inserted into the slots for decorative purposes.

The inner surfaces of the left and right side walls 18 and 20 of the structural member 16 include grooves 44 and 46, the purpose of which will be described in more detail hereinafter. These grooves can either be formed by carving them into the walls or by the projections added to the walls as the member is extruded as shown most clearly in FIG. 1. The grooves 44 and 46 extend the full length of the extruded member 16.

As pointed out above, the second major component of the railing 10 is the connecting block 14. As is well known in the art, connecting blocks are secured to the ends of the railing and are adapted to connect the same to a post or column or wall or other vertical surface. The first embodiment of the connecting block 14 of the present invention is preferably made of nylon or other strong light material.

The block 14 includes a plurality of flat surfaces such as upper surface 48, lower surface 50, a right wall 52 and a left wall 54. In addition, a rear end of the block is defined by the vertical end walls 56 and 58 that meet to define a vertical line while the forward end of the block 14 is defined by the slanted walls 60 and 62 that meet to define a horizontal line 90. As will be apparent to those skilled in the art, the terms left, right rear and forward are relative terms that may change since the orientation of the block 14 may change as explained below. These surfaces are preferably planar and intersect with each other at various angles. For example, the angle between surfaces 56 and 58 is greater than 90° while the angle between the surfaces 60 and 62 may be less than 90°. The block 14 includes a plurality of vertical openings such as shown at 64, 66 and 68 which pass entirely through the block 14. This allows the block 14 to be secured to the horizontal wall 22 of the core member 16 adjacent the end thereof utilizing self-tapping screws 70 and 72.

The block 14 also includes a plurality of substantially horizontal openings such as shown at 74 and 76 that also pass entirely through the block. As shown most clearly in FIG. 4, the openings 74 and 76 on the back side of the block 14 are somewhat elongated in the vertical direction. This allows the screws 78 and 80 to pass therethrough at different vertical inclinations as may be necessary in order to secure the block to a vertical surface. That is, the screws 78 and 80 may not necessarily be oriented exactly horizontally as they pass through the openings 74 and 76 to be secured to a post or the like.

Figure 4:
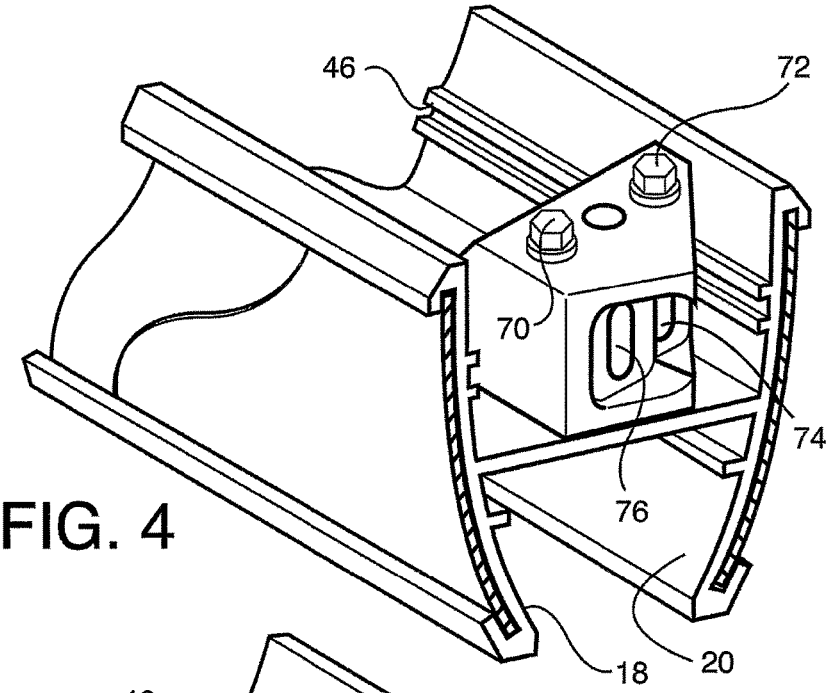
FIG. 4 is an end perspective view of the connecting block of FIG. 3 attached to end of a railing with the rear end of the connecting block exposed.
Figure 5:
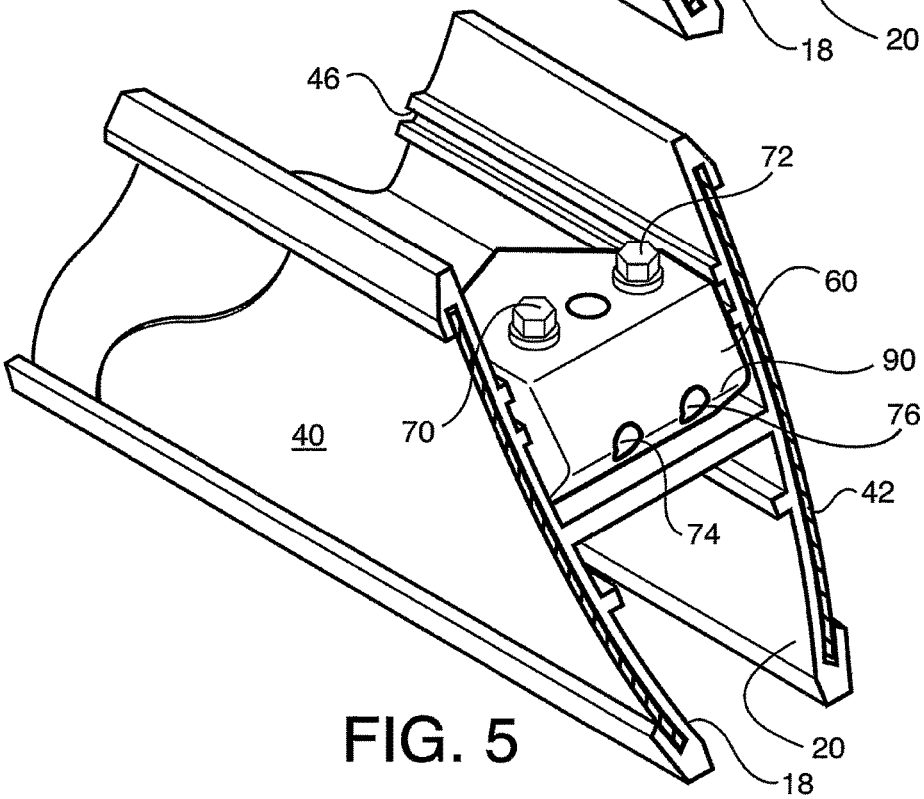
FIG. 5 is an end perspective view of the connecting block of FIG. 2 attached to end of a railing with the connecting block ready to be attached to a vertical surface.

FIGS. 4 and 5 illustrate two of the many different possible arrangements for securing the block 14 to the end of the railing 12 so that the combination can be attached to a post or column or other vertical surface. As is well known in the art, the ends of the structural member 16 along with the caps 28 and 30 will, of course, be cut at the proper angle to meet the vertical surface to which the railing is being attached. Of course, the decorative material 40 and 42 will similarly be cut to fit.

Figure 6:
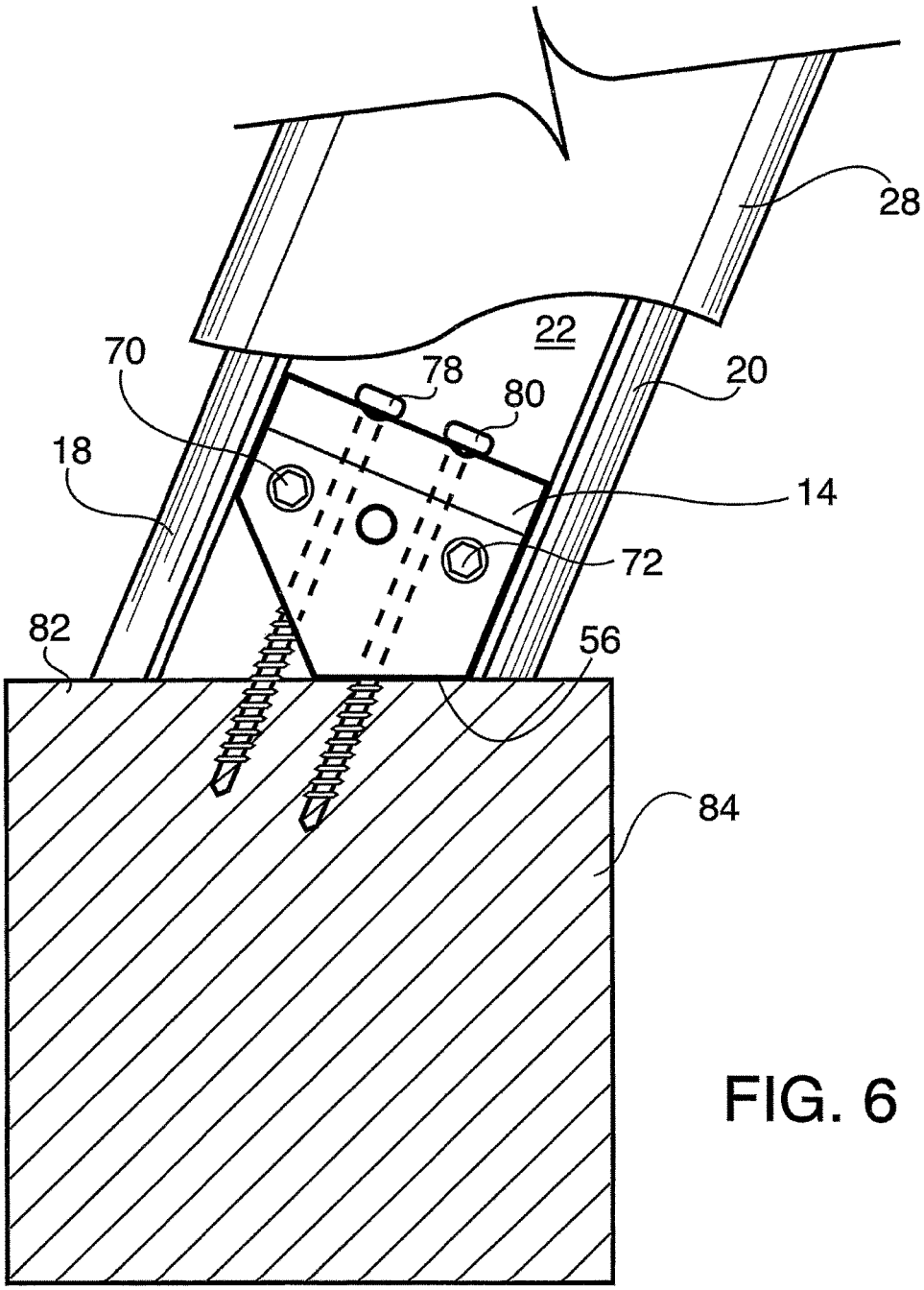
FIGS. 6 and 7 are top plan views, shown partially in cross-section, illustrating the two different angles from which the block of FIG. 3 allows the railing to extend from a vertical surface.
Figure 8:
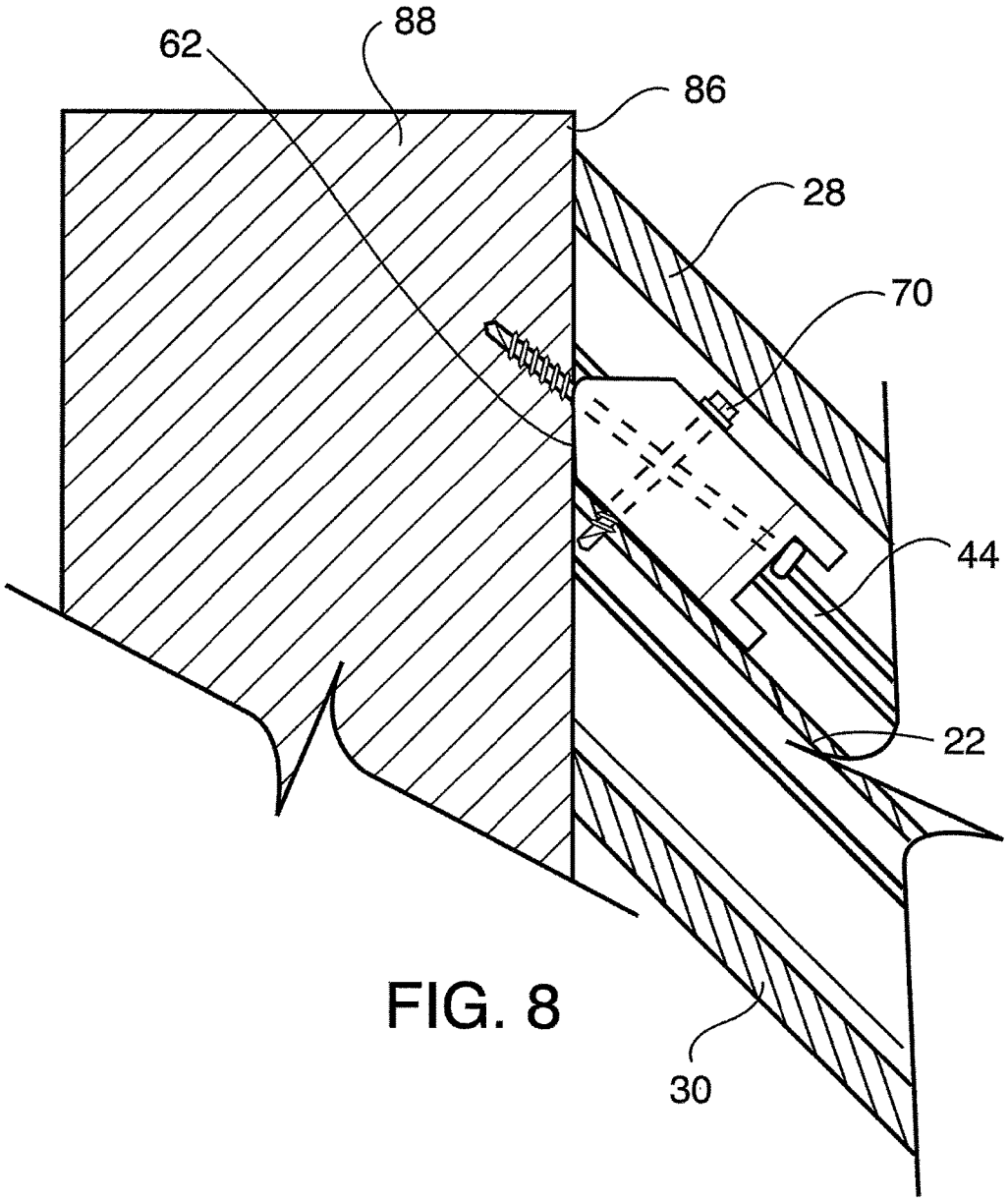
FIGS. 8 and 9 are side views, shown partially in cross-section, illustrating how the block of FIG. 3 can be used to attach a railing to a vertical surface at the top or bottom of a stair hand railing.
Figure 9:
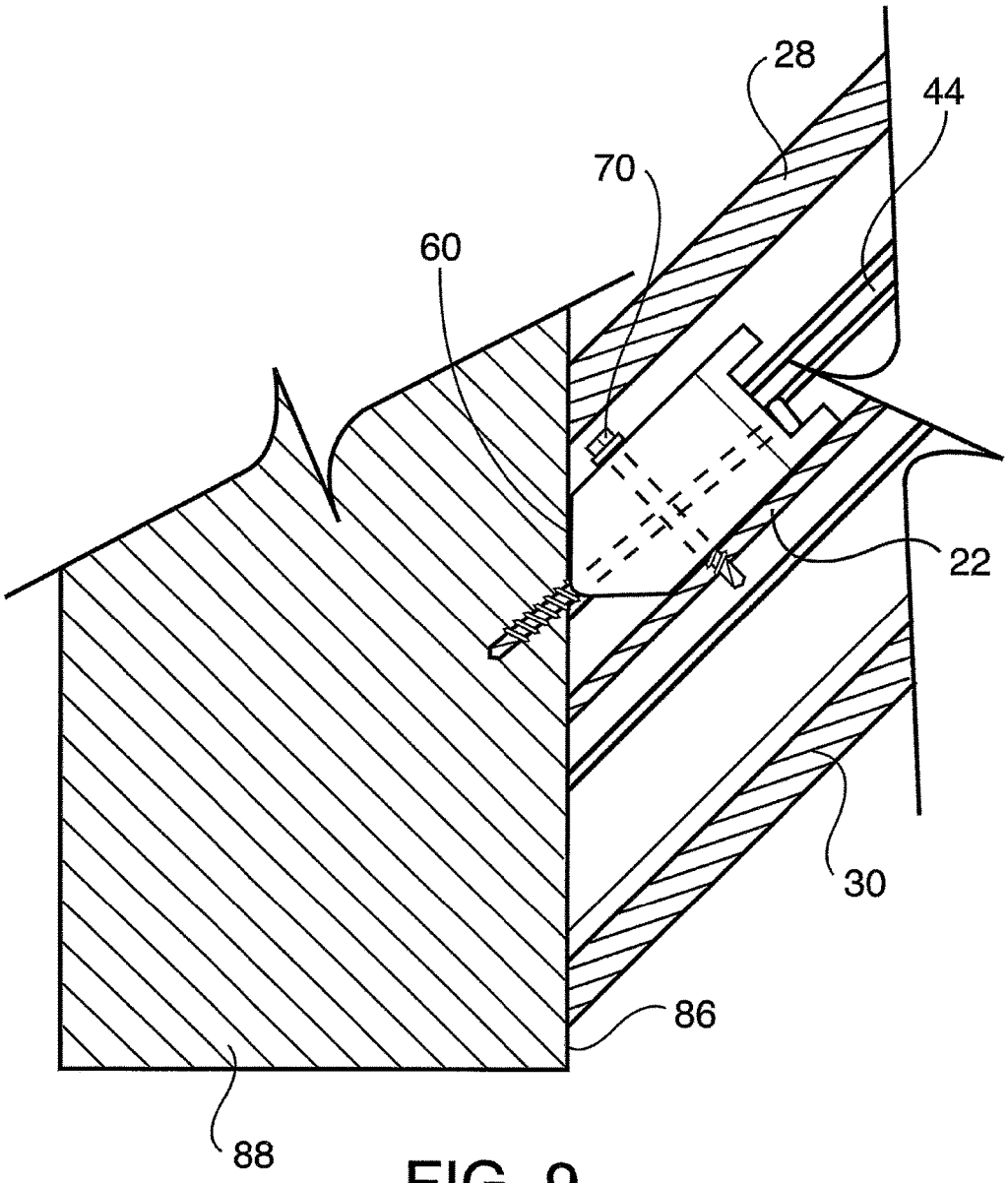
Figure 11:
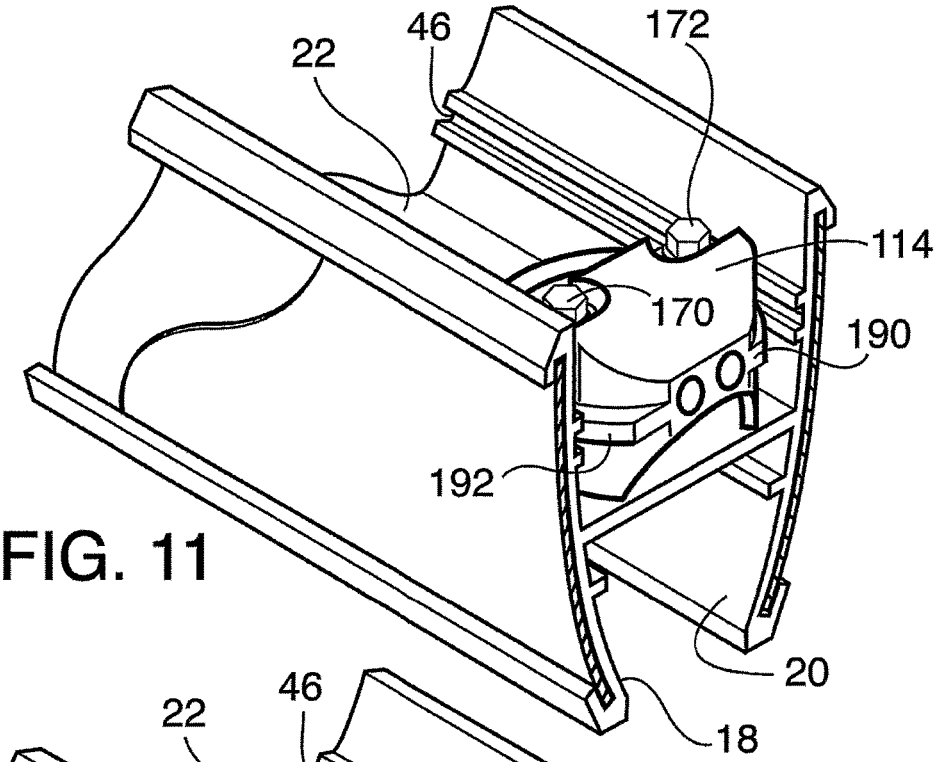
FIG. 11 is an end perspective view of the connecting block of FIG. 10 attached to end of a railing with the railing prepared to be attached to a vertical surface at a substantially 90° degree angle.
Figure 12:
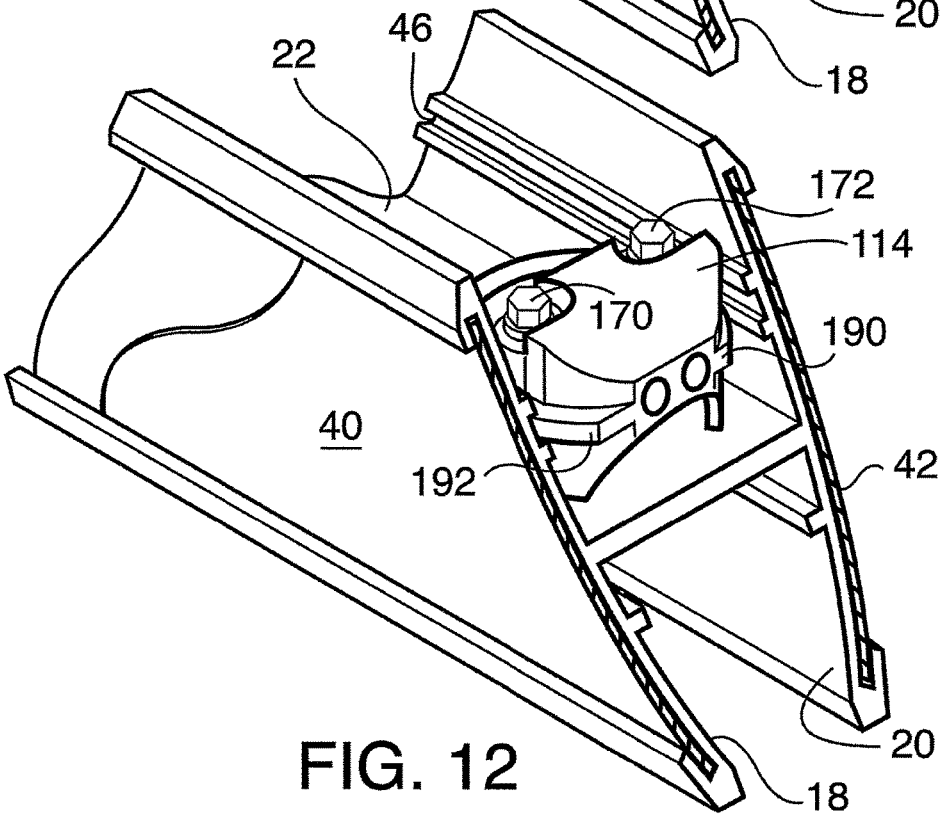
FIG. 12 is an end perspective view of the connecting block of FIG. 10 attached to end of a railing with the railing prepared to be attached to a vertical surface at an angle relative to the horizontal.

FIGS. 5 and 6 are top plan views illustrating how the block 14 can be arranged and secured to the end of the railing 12 so as to extend at different angles to the right or to the left of the vertical surface 82 of a post or column 84. Similarly, FIGS. 8 and 9 show how the block 14 can be secured to the end of the railing 12 and secured to the vertical surface 86 of a wall or column 88 at the top of a staircase or the like so that it is angled downwardly as shown in FIG. 8 or at the bottom wherein it is angled upwardly.

The foregoing are, of course, examples only since the various angles and sides of the block 14 allow the same to be connected at various different angles to various different surfaces. As should be readily apparent to those skilled in the art, the block 14 can also simply be used to secure the railing 12 at exactly 90° from a vertical surface. This can be done simply by having the front end of the block 14 as shown in FIG. 2 parallel with the end of the railing 12 where the intersection 90 between the walls 60 and 62 will abut the vertical surface. Because the intersection 90 defines a straight line which would abut the vertical surface and since the same would be secured in place through the two screws 78 and 80, a strong and secure connection would be made.

Figure 10:
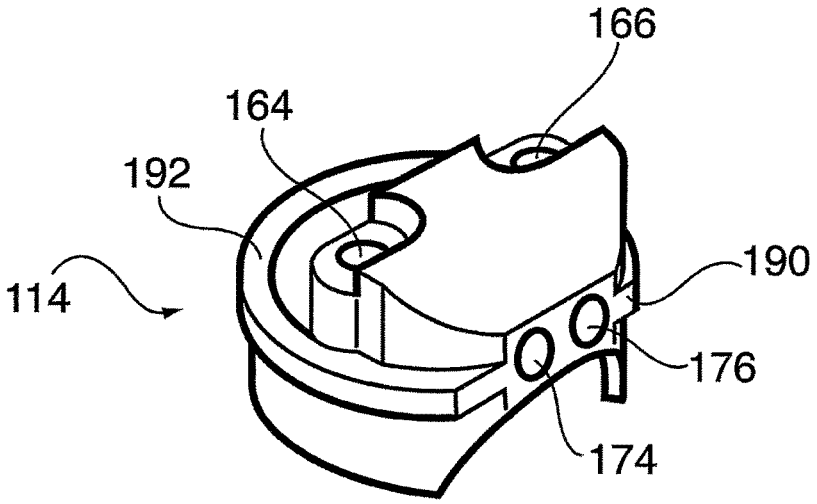
FIG. 10 is a front perspective view of a second embodiment of a connecting block.

FIG. 10 illustrates a second embodiment of a block that is useful with the present invention and is designated generally as 114. Block 114 is also preferably made of nylon although other materials are possible. For convenience, the component parts of the block 114 that are similar to the component parts of block 14 will be identified with the same numbers but preceded with a 1.

Rather than having a plurality of flat surfaces, block 114 is primarily circular but includes a front surface 190 that may be flat or may be somewhat rounded in the vertical direction. In any event, the block 114 also includes a plurality of vertical openings 164 and 166 that allow the same to be secured to the end of a railing. As with the first embodiment, screws 170 and 172 pass down through the openings 164 and 166 to secure the block 114 to the horizontal wall 22. Also, the openings 164 and 176 allow screws 178 and 180 to pass therethrough to secure the block 114 to a post or wall or the like.

Figure 7:
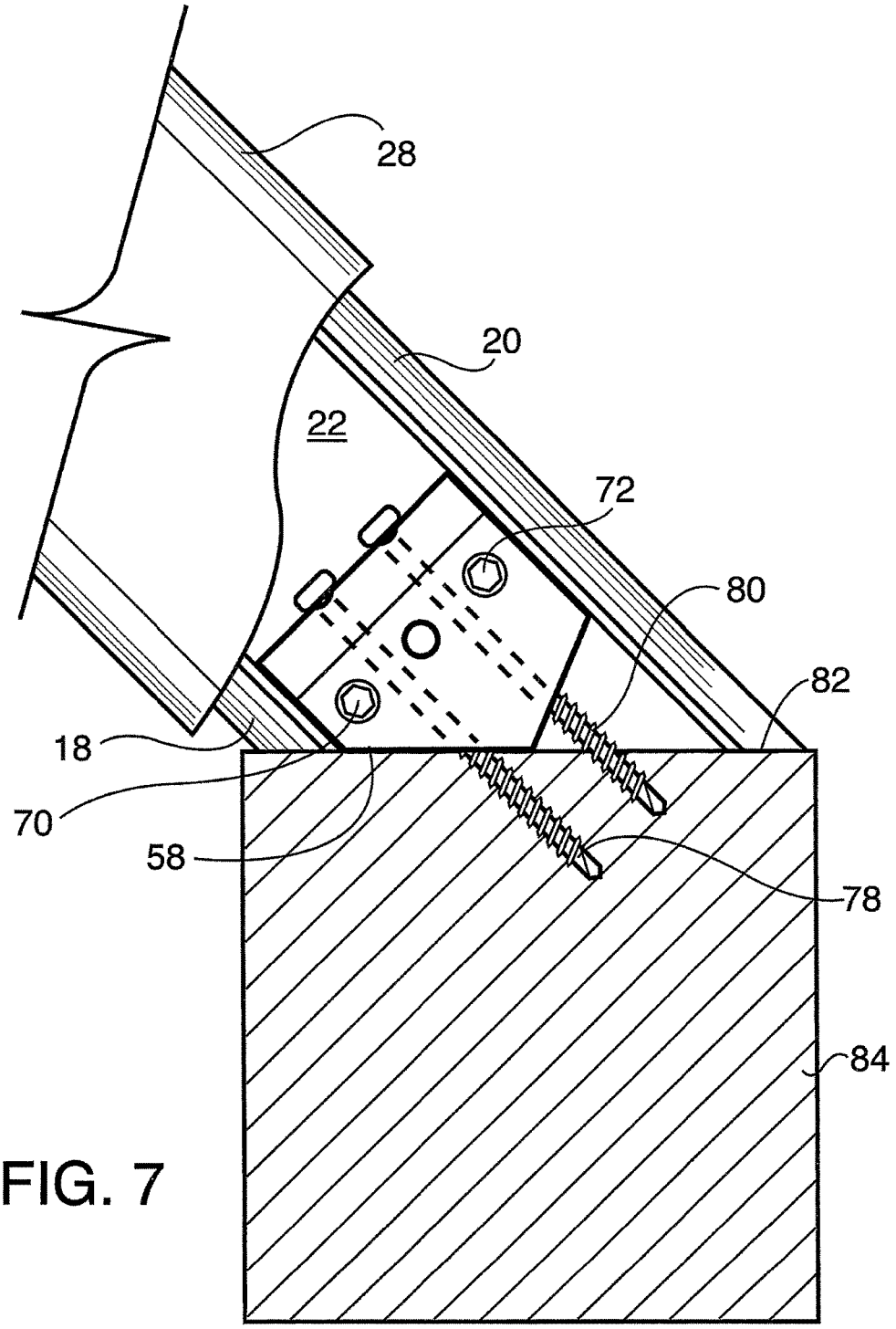
Figure 13:
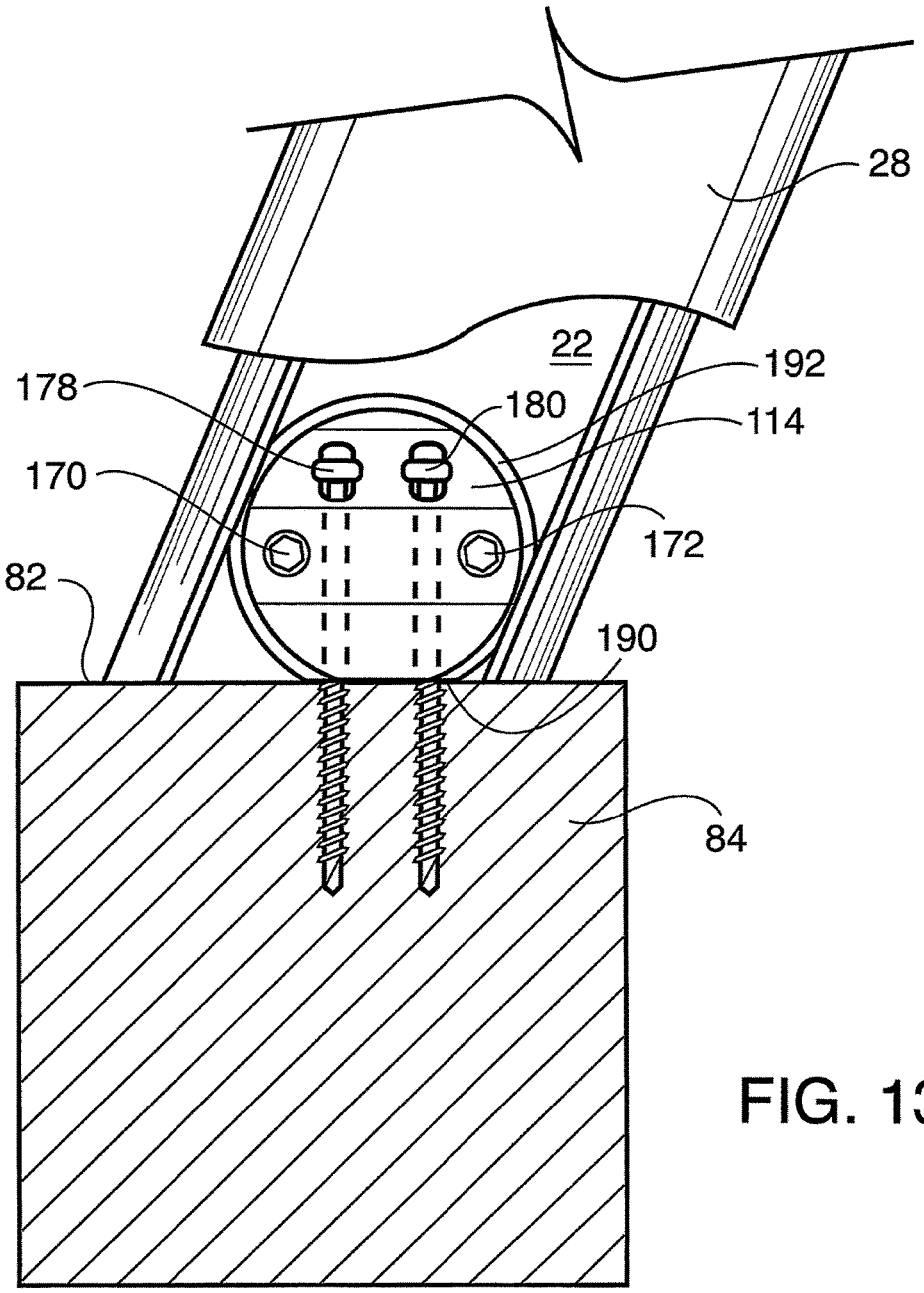
FIG. 13 is a top plan view, shown partially in cross-section, illustrating the block of FIG. 10 extending at an angle from a vertical surface.
Figure 14:
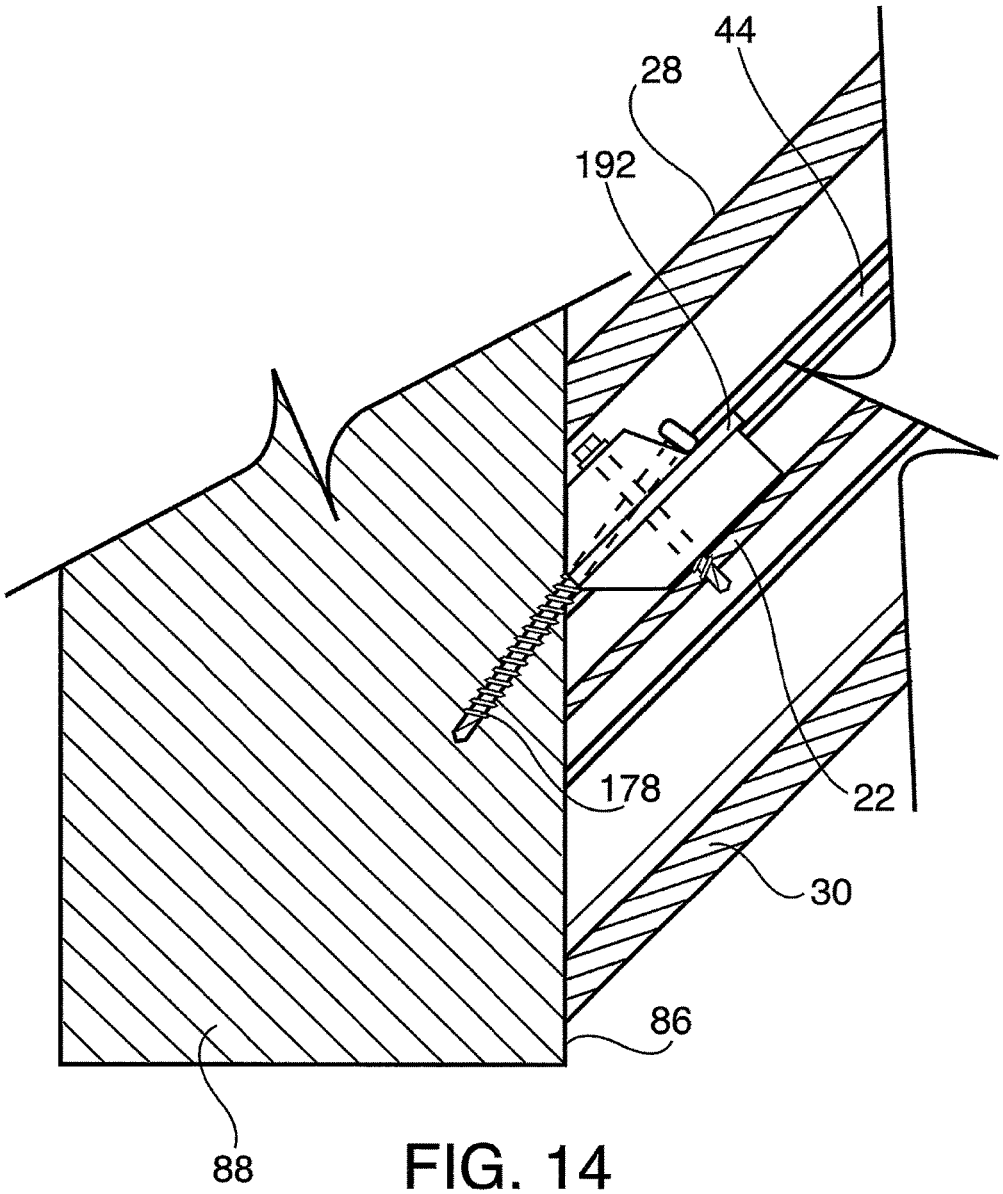
FIGS. 14 and 15 are side views, shown partially in cross-section, illustrating how the block of FIG. 10 can be used to attach a railing to a vertical surface at the top or bottom of a stair hand railing.
Figure 15:
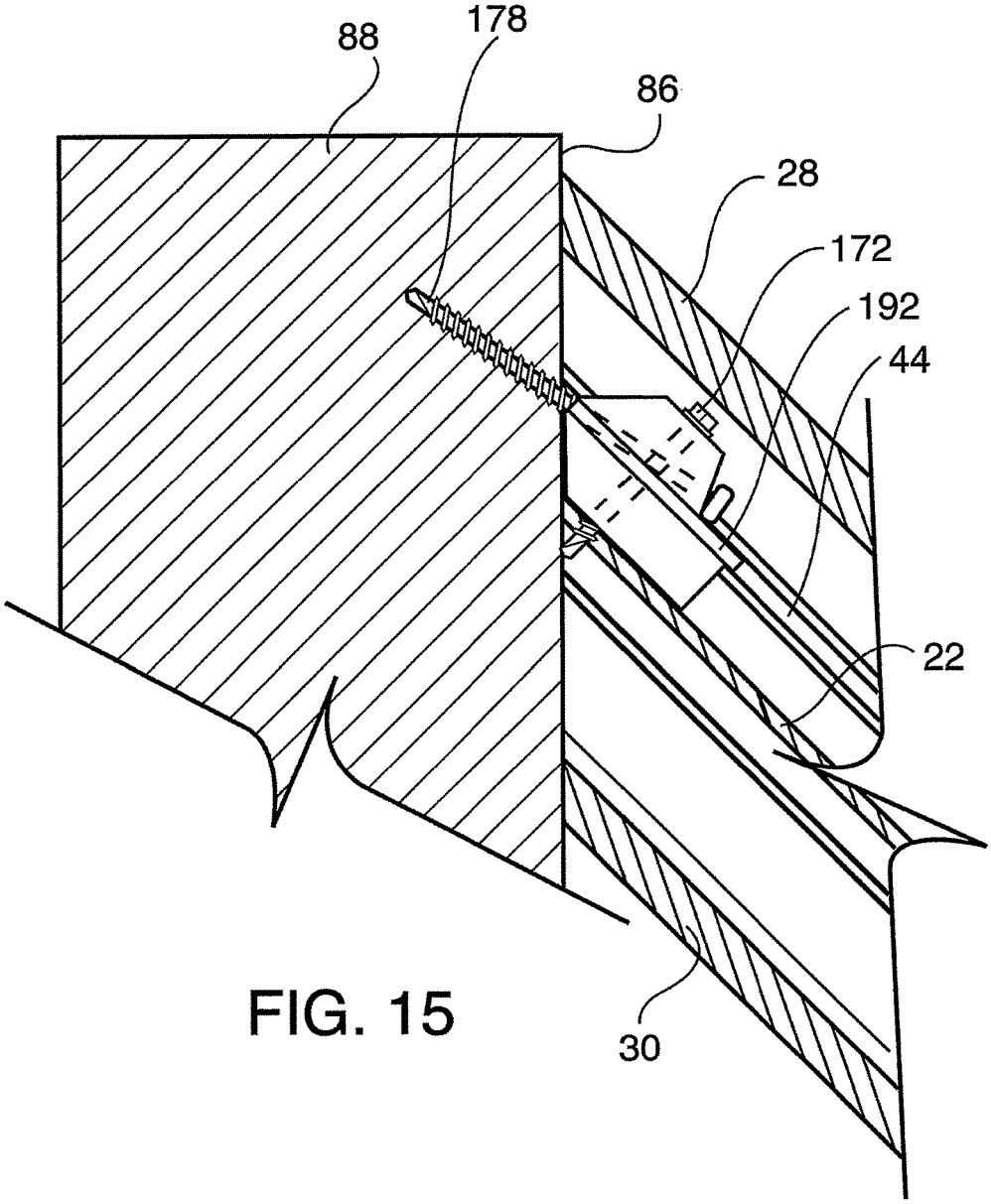

FIGS. 13, 14 and 15 are similar to FIGS. 7, 8 and 9 above and illustrate how the block 114 can be secured to the end of the railing 12 so as to secure the same to a vertical surface. That is, the block 114 can be rotated into substantially any position or any left to right angle. As with the first embodiment (block 14) if it is desired to simply secure the railing 12 at a right angle to a vertical surface, the block 114 is simply positioned at the end of the railing which is cut at a right angle and is secured in the normal way to a vertical surface. The front wall 190 will abut the vertical surface and provide a line abutment which will ensure a secure attachment. This line attachment will also ensure a secure attachment even if the railing slopes downwardly or upwardly from the vertical surface.

In order to help secure the block 114 to the horizontal wall 22 of the extruded structural member 16, the block 114 is provided with a peripheral flange 192. The flange is configured so as to slide within the grooves 44 and 46. This prevents movement of the block 114 in the vertical direction as it is being installed on the horizontal wall 22.

The peripheral flange 192 can be slid into the grooves 44 and 46 from the end of the railing 12. However, since the flange 192 does not extend all the way around the block 114, it can be inserted at almost any place, if desired. This is accomplished by inserting the block 114 with the front wall 190 parallel to one of the grooves 44 or 46 and then rotating the same so that the flange 192 rotates into the grooves.

The present invention may be embodied in other specific forms without departing from the spirit or essential attributes thereof and accordingly, reference should be made to the appended claims rather than to the foregoing specification as indicating the scope of the invention.

I claim:

1. A railing adapted to extend between and secured to posts or other substantially vertical surfaces so as to function as a hand rail including:

an elongated extruded structural member;

said structural member having left and right spaced apart substantially vertically extending side walls that extend the length of said structural member, each of said right and left side walls including a pair of opposing top and bottom slots into which elongated sheet material can slide;

said structural member further including a horizontal wall extending between said vertically extending walls thereby forming a substantially H-shaped cross-section with an open top and an open bottom at substantially any point along the length of said structural member, and including top and bottom caps adapted to close said open top and said open bottom, respectively, while leaving said side walls exposed, and a block secured to an end of said structural member and being adapted to attach said structural member to a vertical surface, said block having the ability to be secured to said structural member in a plurality of different orientations to thereby allow said structural member to be attached to said vertical surface in a plurality of different angles relative thereto.

2. The railing as claimed in claim 1 wherein said block is secured to said horizontal wall.

3. The railing as claimed in claim 2 wherein said block includes a plurality of vertical openings therein and further including a first plurality of screws adapted to pass through said vertical openings and into said horizontal wall.

4. The railing as claimed in claim 3 wherein said block includes a plurality of horizontal openings therein and further including a second plurality of screws adapted to pass through said horizontal openings and into said post or other vertical surface.

5. The railing as claimed in claim 1 wherein said block includes a plurality of intersecting flat surfaces.

6. The railing as claimed in claim 5 wherein at least two of said flat surfaces intersect at an angle of more than 90°.

7. The railing as claimed in claim 5 wherein at least two of said flat surfaces intersect at an angle of less than 90°.

8. A railing adapted to extend between and secured to posts or other substantially vertical surfaces so as to function as a hand rail including:

an elongated extruded structural member;

said structural member having left and right spaced apart substantially vertically extending walls that extend the length of said structural member;

said structural member further including a horizontal wall extending between said vertically extending walls thereby forming a substantially H-shaped cross-section with an open top and an open bottom at substantially any point along the length of said structural member, and a block secured to an end of said structural member and being adapted to attach said structural member to a vertical surface, said block having the ability to be secured to said structural member in a plurality of different orientations to thereby allow said structural member to be attached to said vertical surface in a plurality of different angles relative thereto; said block including an upper surface, a lower surface, a right wall, a left wall, a forward end and a rear end, one of said ends includes a pair of vertical end walls that meet to define a vertical line, the other of said ends includes a pair of slanted walls that meet to define a horizontal line.

9. The railing as claimed in claim 8 further including top and bottom caps adapted to close said open top and said open bottom, respectively.

10. The railing as claimed in claim 8 wherein each of said right and left walls includes means for holding elongated sheet material thereon.

11. The railing as claimed in claim 10 wherein said means for holding includes a pair of opposing top and bottom slots into which said sheet material can slide.

12. The railing as claimed in claim 8 wherein said block is secured to said horizontal wall.

13. The railing as claimed in claim 12 wherein said block includes a plurality of vertical openings therein and further including a first plurality of screws adapted to pass through said vertical openings and into said horizontal wall.

14. The railing as claimed in claim 13 wherein said block includes a plurality of horizontal openings therein and further including a second plurality of screws adapted to pass through said horizontal openings and into said post or other vertical surface.

* * * * *